United States Patent [19]

Kaeser

[11] 4,311,607

[45] * Jan. 19, 1982

[54] METHOD FOR MANUFACTURE OF NON-GELLING, STABLE ZEOLITE - INORGANIC SALT CRUTCHER SLURRIES

[75] Inventor: James A. Kaeser, Somerset, N.J.

[73] Assignee: Colgate Palmolive Company, New York, N.Y.

[ * ] Notice: The portion of the term of this patent subsequent to Oct. 13, 1998, has been disclaimed.

[21] Appl. No.: 199,603

[22] Filed: Oct. 21, 1980

Related U.S. Application Data

[63] Continuation-in-part of Ser. No. 157,568, Jun. 9, 1980, which is a continuation-in-part of Ser. No. 128,574, Mar. 10, 1980.

[51] Int. Cl.[3] ..... C11D 3/08; C11D 3/10; C11D 3/12; C11D 11/02

[52] U.S. Cl. ..... 252/140; 252/91; 252/174; 252/174.13; 252/174.14; 252/174.21; 252/174.25; 252/179

[58] Field of Search ..... 252/91, 140, 174, 174.13, 252/174.14, 174.21, 174.25, 179

[56] References Cited

U.S. PATENT DOCUMENTS

| | | | |
|---|---|---|---|
| 3,594,323 | 7/1971 | Taylor | 252/526 |
| 3,869,399 | 3/1975 | Collins | 252/118 |
| 3,886,098 | 5/1975 | Di Salvo | 252/540 |
| 3,893,955 | 7/1975 | Hewitt | 252/551 |
| 4,075,117 | 2/1978 | Morton | 252/135 |
| 4,180,485 | 12/1979 | Llenado | 252/532 |

FOREIGN PATENT DOCUMENTS

| | | | |
|---|---|---|---|
| 2003913 | 3/1979 | United Kingdom | 252/135 |

*Primary Examiner*—Dennis L. Albrecht

[57] ABSTRACT

Gelation and setting of desirably miscible and pumpable aqueous crutcher slurries comprising zeolite (hydrated sodium aluminosilicate), sodium bicarbonate, sodium silicate and sodium carbonate are retarded and often are prevented by the addition of sodium sesquicarbonate (which also serves as a source of sodium carbonate and sodium bicarbonate) after admixing of the zeolite, sodium bicarbonate, sodium carbonate (if added earlier) and sodium silicate. Desirably, citric acid (and preferbly also, magnesium sulfate) is(are) dissolved in the crutcher medium before addition of the sodium sesquicarbonate but the presence(s) thereof is(are) not necessary. The method of the invention appreciably increases workable crutcher time, stabilizing the mix against gelation, compared to prior methods for the manufacture of similar crutcher mixes of similar contents of water, zeolite, bicarbonate, carbonate and silicate (considering the sesquicarbonate of the present method as a source of carbonate and bicarbonate), whether all the carbonate and bicarbonate are separately added to the crutcher before the silicate or are added partially before and partially after silicate addition. The improved workability and stability of the crutcher mix permit the making of higher solids content crutcher slurries, thereby resulting in significant energy savings and increases in production rates when such slurries are subsequently spray dried to produce free flowing zeolite - inorganic salt base beads, from which beads built or heavy duty detergent compositions may be made by post-spraying onto them a nonionic synthetic organic detergent in liquid state.

18 Claims, No Drawings

METHOD FOR MANUFACTURE OF NON-GELLING, STABLE ZEOLITE - INORGANIC SALT CRUTCHER SLURRIES

This application is a continuation-in-part of my copending application Ser. No. 157,568, filed June 9, 1980, which is a continuation-in-part of my copending application Ser. No. 128,574, filed Mar. 10, 1980.

This invention relates to a method for the manufacture of non-gelling, stable zeolite-inorganic salt crutcher slurries which are useful for the manufacture of built detergent compositions. Such slurries have been referred to heretofore in the title, abstract and previous sentence of this specification as zeolite-inorganic salt slurries to distinguish them from the non-zeolite inorganic salt slurries of my copending application Ser. No. 128,574 and the non-zeolite slurries of an application entitled Method For Manufacture of Non-Gelling, Stable Inorganic Salt Crutcher Slurries being filed by me on the same date as the present application. However, for simplicity, and in view of the fact that zeolites are inorganic salts, henceforth in the specification and in the claims the present zeolite-containing slurries may be referred to as inorganic salt slurries. More particularly, the present invention relates to the manufacture of such inorganic salt slurries in which sodium sesquicarbonate is incorporated (and serves as a source of sodium carbonate and sodium bicarbonate) by admixing it with other components of final relatively high solids content aqueous inorganic salt slurries including zeolite, sodium bicarbonate and sodium silicate (and sometimes additional sodium carbonate), whereby such slurries are stabilized, and gelation, excess thickening and setting thereof are prevented, retarded or substantially diminished.

As was mentioned in my prior applications Ser. No's. 128,574 and 157,568, the disclosures of which are incorporated herein by reference, some household laundry detergent compositions are now made by spray drying inorganic builder salt mixtures, devoid of organic detergent, and subsequently spraying onto the surfaces of the resulting spray dried beads a nonionic detergent in liquid state, so that it is absorbed by the beads. Among the more satisfactory products made by this method are those produced by absorbing into such bead interiors a nonionic detergent, such as a condensation product of a poly-lower alkylene oxide and a lipophilic material, e.g., higher fatty alcohol, with the beads being comprised of alkali metal bicarbonate, alkali metal carbonate and alkali metal silicate, and in some cases, with hydrated sodium aluminosilicate (zeolite). However, it has been found that aqueous crutcher slurries or crutcher mixes containing substantial proportions of bicarbonate, carbonate, silicate and zeolite tend to gel or set prematurely, sometimes before they can be thoroughly mixed and pumped out of a crutcher to a spray tower, and consequently, extensive experimentation has been undertaken in an effort to find ways to diminish tendencies of such systems to solidify or gel in the crutcher. For aqueous crutcher slurries containing zeolite, sodium carbonate, sodium bicarbonate and sodium silicate, with the zeolite being added as a hydrate, in powder form, the carbonate and bicarbonate being added as anhydrous powders and the silicate being added as an aqueous solution, setting of the slurry or mix occurs most readily when the carbonate content (which often may be about the same as the silicate solids content, e.g., often about 5 to 25%, preferably 10 to 17%, on a solids basis) is more than about 20% of the bicarbonate content.

Prior to the present invention it had been discovered by a fellow researcher that small quantities of citric acid or water soluble citrate incorporated in the crutcher mix could delay or prevent gelation or setting of bicarbonate-carbonate-silicate mixes and would allow commercial spray drying thereof, following normal procedures for pumping out of the crutcher contents to the spray nozzles. Such invention is described in U.S. patent application Ser. No. 81,799, filed Oct. 4, 1979 by Ronald S. Schreiber. An improvement over that invention was subsequently discovered by the present inventor, and is described in Ser. No. 128,574. Essentially, such discovery is that the anti-gelling effect of the citric material is increased when magnesium sulfate is also present. A further advantage of such invention is that the proportion of organic material (the citric material) in the inorganic salt product being made can be decreased. Subsequently, in Ser. No. 157,568 it was disclosed by the present inventor that inorganic salt crutcher mixes containing substantial proportions of zeolite could also be stabilized so that gelation and setting could be prevented or retarded, by the addition of citric material and magnesium sulfate. Now, as a result of the present invention, it is not necessary, although it is sometimes additionally desirable, to utilize the magnesium sulfate additive, lesser amounts of citric acid may be employed, and often citric acid may be eliminated entirely. The anti-gelling material (sodium sesquicarbonate), utilized at a particular step in the making of the crutcher mix, also serves as a source of active builders for the final detergent product.

In accordance with the present invention a method of retarding or preventing the gelation of a crutcher slurry containing from about 40 to 70% of solids and 60 to 30% of water, of which solids content, on a 100% solids basis, about 20 to 60% is zeolite, about 11 to 45% is sodium bicarbonate, about 4 to 20% is sodium carbonate and about 5 to 20% is sodium silicate of $Na_2O:SiO_2$ ratio within the range of 1:1.4 to 1:3, with the ratio of sodium bicarbonate:sodium carbonate being within the range of about 1.2:1 to 8:1, the ratio of sodium carbonate:sodium silicate being within the range of about 1:3 to 3:1, the ratio of sodium bicarbonate:sodium silicate being within the range of about 1.5:1 to 5:1 and the ratio of zeolite to the sum of sodium bicarbonate, sodium carbonate and sodium silicate being within the range of about 1:4 to 4:1, comprises preparing a crutcher slurry of the described composition by admixing with other components of such slurry portions of sodium carbonate and the sodium bicarbonate as sodium sesquicarbonate. In preferred embodiments of the invention some citric material will be present in the crutcher, sometimes with magnesium sulfate, the order of addition of the components will be specified, the crutcher, aqueous medium and slurry will be at an elevated temperature, mixing will continue for at least an hour or two in the crutcher without gelation, and the crutcher slurry will be spray dried to free flowing inorganic base beads containing zeolite, which are capable of absorbing nonionic detergent, when it is in liquid form, to make finished built detergent compositions.

Without admitting that for the purpose of the Patent Law it is applicable prior art, it is recognized by the present inventor that prior to his invention the most preferred ways of retarding gelation of aqueous bicarbonate-carbonate-silicate-zeolite crutcher slurries were those described in his U.S. patent application Ser. No. 157,568. Also relevant are Ronald S. Schreiber's U.S. patent application Ser. No. 81,799 and the present inventor's U.S. patent application Ser. No. 128,574. Prior to Schreiber's work sodium citrate had been a known water softening and organic builder constituent of synthetic organic detergent compositions. Also, it had been suggested that magnesium salts could be added to synthetic detergent compositions or to wash waters containing them so as to increase foaming of anionic synthetic organic detergents in such media. The problem of soluble silicates forming insoluble products in solutions of detergent compositions in wash water had been recognized and efforts had been made to prevent the objectionable depositing of silicates onto laundered articles. Particular polyvalent metals had been suggested for "capping" alkali metal silicates to reduce polymerization thereof. For example, see U.S. Pat. No. 4,157,978. Also, sodium sesquicarbonate had been recognized as a useful builder in detergent compositions and its formula, $Na_2CO_3.NaHCO_3.2H_2O$, indicates to those of skill in the art that it may act as a source of sodium carbonate and sodium bicarbonate. However, the prior art does not suggest the exceptionally good and unexpectedly beneficial anti-gelling and stabilizing effects of the utilization of sodium sesquicarbonate and its addition to crutcher slurries of the present type after additions of the zeolite, bicarbonate, silicate and any carbonate that may be included. Furthermore, the prior art does not suggest the stabilizing effect of the late addition of sodium sesquicarbonate to such crutcher mixes containing small anti-gelling proportions of citric material or of citric material plus magnesium sulfate.

Although the anti-gelling features of the present invention may also be obtained with other inorganic builder base composition slurries than those of this invention, which are primarily of ion exchanging zeolite, such as hydrated Zeolite A, sodium bicarbonate, sodium carbonate, sodium silicate and water, the most significant anti-gelling and stabilizing effects are noted when crutcher slurries based substantially (preferably essentially) on such sodium salts and water are treated by the method of this invention, i.e., addition of sodium sesquicarbonate to such a slurry after the making of the slurry has been completed except for the addition of the sesquicarbonate, and when the slurry is in mobile pumpable form. Often, the crutcher mix is prevented from gelling before the addition of the stabilizing and anti-gelling sodium sesquicarbonate by the presence of citric material, such as citric acid, in some cases with magnesium sulfate also being present, or with magnesium citrate being used instead of the citric acid-magnesium sulfate combination. The compositions treated by the method of the present invention comprise about 40 to about 70% of solids and about 60 to about 30% of water. The solids contents, on a 100% solids basis, are about 20 to about 60% of zeolite, about 11 to about 45% of sodium bicarbonate, about 4 to about 20% of sodium carbonate and about 5 to about 20% of sodium silicate, with the sodium silicate being of $Na_2O:SiO_2$ ratio within the range of 1:1.4 to 1:3. In such compositions the ratio of sodium bicarbonate:sodium carbonate is within the range of about 1.2:1 to about 8:1, the ratio of sodium carbonate:sodium silicate is within the range of about 1:3 to 3:1, the ratio of sodium bicarbonate:sodium silicate is within the range of about 1.5:1 to about 5:1 and the ratio of zeolite to the sum of sodium bicarbonate, sodium carbonate and sodium silicate is within the range of about 1:4 to about 4:1.

Because the sodium sesquicarbonate added at the end of the making of the crutcher slurry may be considered to be comprised of sodium carbonate and sodium bicarbonate, the proportions thereof present in the sesquicarbonate, about 47% and about 37%, respectively, should be calculated in the crutcher slurry formula as being parts of the carbonate and bicarbonate components and as parts of the solids content thereof. Also, the hydrating water present with the sesquicarbonate, about 16% thereof, is counted as being part of the solids content of the crutcher mix because for the most part it is considered that a significant proportion of the sesquicarbonate remains undissolved in the crutcher slurry. Similarly, the hydrating water present with the zeolite, usually considered to be about 20% of the weight thereof (more fully hydrated Zeolite A includes about 22.5% water of hydration), should be considered as part of the solids content of the crutcher mix.

It has been theorized by the present inventor that the generation of sodium sesquicarbonate in the crutcher, when crutcher slurries are made with zeolite, sodium bicarbonate powder, soda ash, and sodium silicate solution, in an aqueous medium, may be contributory to undesirable thickening, gelation and freezing of such slurries. On this basis, his addition of sodium sesquicarbonate, which is in finely divided form (all the materials added as solids to form the slurry are in similar finely divided form) may be helping to "seed" the medium and thereby produce additional sesquicarbonate crystals of smaller particle sizes than would otherwise result. Thus, the slurry viscosity would be stabilized and freezing and setting in the crutcher would be avoided. Although this theory seems to be valid, and explains the results obtained, applicant is not bound by it and patentability of his invention does not depend on it. In this specification, when sodium sesquicarbonate is referred to, as it was above, it is meant to denote the dihydrate-type product, which is available as naturally occurring trona.

Preferably, the crutcher slurry contains from 50 to 65% of solids and 50 to 35% of water, of which solids content 30 to 50% is zeolite, 25 to 40% is sodium bicarbonate, 8 to 17% is sodium carbonate and 8 to 18% is sodium silicate of $Na_2O:SiO_2$ ratio within the range of 1:1.6 to 1:2.6. The ratio of sodium bicarbonate:sodium carbonate is preferably within the range of 1.5:1 to 3:1, the ratio of sodium carbonate:sodium silicate is preferably within the range of 1:2 to 2:1, the ratio of sodium bicarbonate:sodium silicate is preferably within the range of 1.5:1 to 3:1 and the ratio of zeolite to the sum of sodium bicarbonate, sodium carbonate and sodium silicate is preferably within the range of 1:3 to 2:1.

In the present invented method sodium sesquicarbonate is utilized in place of portions of the bicarbonate and carbonate, normally supplying up to 100% of the sodium carbonate, preferably about 20 or 25 to 100% thereof, e.g., 40 to 80%. In the preferred crutcher mixes, while it is not necessary for citric material, such as citric acid, and magnesium sulfate, to be present, because the sodium sesquicarbonate has an anti-gelling and stabilizing effect on mobile, miscible and pumpable crutcher slurries made without such materials, normally it is preferable for the crutcher slurry to contain 0.05 to 1% of the citric material, such as citric acid, water soluble citrate, e.g., sodium citrate, potassium citrate, magnesium citrate, or a mixture thereof. Such citric material is incorporated in the slurry before addition of the sodium sesquicarbonate thereto and preferably, before addition of the sodium silicate, or at least before addition of a part, e.g., an equal or major part, of the sodium silicate. For additional anti-gelling effects, when such are desirable, the crutcher slurry may contain from 0.1 to 2% of magnesium sulfate too, preferably from 0.1 to 1.4%. Magnesium which is present in magnesium citrate may be employed in replacement of a stoichiometric equivalent thereof in magnesium sulfate. More preferable percentages of citric acid utilized (than the broader range given above) are from 0.1 to 0.5 and those of magnesium sulfate, when present, are from 0.2 to 1.5, e.g., 0.8 to 1.2. When the citric material and magnesium sulfate or equivalent magnesium compound are employed together it is preferred that at least 0.4% of the sum thereof be present.

In more preferred methods of manufacture of stable slurries within the present invention the compositions of the crutcher slurry are from 53 to 65% of solids and 47 to 35% of water, with the solids content being 35 to 45% of zeolite, 25 to 35% of sodium bicarbonate, 10 to 15% of sodium carbonate and 10 to 15% of sodium silicate. In such slurries the ratio of sodium bicarbonate:sodium carbonate is within the range of 1.7:1 to 2.2:1, the ratio of sodium carbonate:sodium silicate is within the range of 0.7:1 to 1.3:1, the ratio of sodium bicarbonate:sodium silicate is within the range of 1.7:1 to 2.4:1 and the ratio of zeolite to the sum of sodium bicarbonate, sodium carbonate and sodium silicate is within the range of 1:2 to 1:1. The sodium silicate in such slurries is of $Na_2O:SiO_2$ ratio within the range of 1:1.6 to 1:2.4, the citric material, when present, is added as citric acid, the percentage of citric acid is from 0.4 to 0.8% and the percentage of sodium sesquicarbonate added is from 5 to 32% (molecular weight basis of 226). This is from about 25 to 100% of the desired sodium carbonate content of the slurry but preferably from 50 to 100% of such carbonate content will be in the form of the sesquicarbonate, and these ratios also apply to less preferred crutcher mixes within the present invention (or in which the manufacturing methods are within the invention).

The materials described above, except water, are all normally solid and the percentages of ranges given are on an anhydrous basis, except for the zeolite and except for the sesquicarbonate when its solids content is being considered. The various materials may be added to the crutcher as hydrates or they may be dissolved or dispersed in water. Normally, the sodium bicarbonate is an anhydrous powder and the sodium carbonate is soda ash, also in powder form, as are the sodium zeolite, usually Zeolite A, preferably Zeolite 4A hydrate, and the sodium sesquicarbonate. Sodium carbonate monohydrate may also be employed, as may be other hydrated forms of such crutcher mix constituents, when such is more feasible. The silicate is usually added to the crutcher slurry as an aqueous solution, normally of 40 to 50% solids content, e.g., 47.5%, and is preferably added near the end of the mixing, before the sesquicarbonate but after previous addings and dispersings of any citric material and magnesium sulfate (or magnesium citrate) which may be utilized, and after additions of zeolite, bicarbonate and carbonate, when carbonate is added before the sesquicarbonate. Most preferably, the silicate will be of $Na_2O:SiO_2$ ratio in the range of 1:2.0 to 1:2.4, e.g., 1:2.35 or 1:2.4.

The zeolites employed include crystalline, amorphous and mixed crystalline-amorphous zeolites of both natural and synthetic origins which are of satisfactorily quick and sufficiently effective activities in counteracting calcium hardness ions in wash waters. Preferably, such materials are capable of reacting sufficiently rapidly with the calcium ions so that, alone or in conjunction with other water softening compounds in the detergent, they soften the wash water before adverse reactions of such ions with other components of the synthetic organic detergent composition occur. The zeolites employed may be characterized as having a high exchange capacity for calcium ion, which is normally from about 150 to 400 or more milligram equivalents of calcium carbonate hardness per gram of the aluminosilicate, preferably 175 to 275 mg. eq./g. Also they preferably have a hardness depletion rate residual hardness of 0.02 to 0.05 mg. $CaCO_3$/liter in one minute, preferably 0.02 to 0.03 mg./l., and less than 0.01 mg./l. in 10 minutes (all calculations being on an anhydrous zeolite basis).

Although other ion exchanging zeolites may also be utilized, normally the finely divided synthetic zeolite builder particles employed in the practice of this invention will be of the formula $$(Me_2O)_x \cdot (Al_2O_3)_y \cdot (SiO_2)_z \cdot wH_2O$$

wherein Me represents a metal or other suitable cationic material, x is 1, y is from 0.8 to 1.2, preferably about 1, z is from 1.5 to 3.5, preferably 2 to 3 or about 2 and w is from 0 to 9, preferably 2.5 to 6. Normally the preferred hydrate employed contains four or five moles of water, preferably about four.

The zeolite should be a univalent cation-exchanging zeolite, i.e., it should be an aluminosilicate of an univalent cation such as sodium, potassium, lithium (when practicable) or other alkali metal, ammonium or hydrogen (sometimes). Preferably the univalent cation of the zeolite molecular sieve is an alkali metal cation, especially sodium or potassium, and most preferably is sodium.

Crystalline types of zeolites utilizable as good or acceptable ion exchangers in the invention, at least in part, include zeolites of the following crystal structure groups: A, X, Y, L, mordenite and erionite, of which types A, X and Y are preferred. Mixtures of such molecular sieve zeolites can also be useful, especially when type A zeolite is present. These crystalline types of zeolites are well known in the art and are more particularly described in the text *Zeolite Molecular Sieves* by Donald W. Breck, published in 1974 by John Wiley & Sons. Typical commercially available zeolites of the aforementioned structural types are listed in Table 9.6 at pages 747–749 of the Breck text, which table is incorporated herein by reference. Also, suitable zeolites have been described in many patents in recent years for use as detergent composition builders, and such may also be employed.

The zeolite used in the invention is usually synthetic and it is often characterized by having a network of substantially uniformly sized pores in the range of about 3 to 10 Angstroms, often being about 4 A (normal), such size being uniquely determined by the unit structure of the zeolite crystal. Preferably it is of type A or similar structure, particularly described at page 133 of the aforementioned text. Good results have been obtained when a Type 4A molecular sieve zeolite is employed, wherein the univalent cation of the zeolite is sodium and the pore size of the zeolite is about 4 Angstroms. Such zeolite molecular sieves are described in U.S. Pat. No. 2,882,243, which refers to them as Zeolite A.

Molecular sieve zeolites can be prepared in either a dehydrated or calcined form which contains from about 0 or about 1.5% to about 3% of moisture or in a hydrated or water loaded form which contains additional bound water in an amount from about 4% up to about 36% of the zeolite total weight, depending on the type of zeolite used. The water-containing hydrated form of the molecular sieve zeolite (preferably about 15 to 90%, e.g., 15 to 70% hydrated) is preferred in the practice of this invention when such crystalline product is used. The manufacture of such crystals is well known in the art. For example, in the preparation of Zeolite A, referred to above, the hydrated zeolite crystals that are formed in the crystallization medium (such as a hydrous amorphous sodium aluminosilicate gel) are used without being subject to high temperature dehydration (calcining to 3% or less water content) that is normally practiced in preparing such crystals for use as catalysts, e.g., cracking catalysts. The crystalline zeolite, especially that of Type A, is completely hydrated or partially hydrated form, can be recovered by filtering off the crystals from the crystallization medium and drying them in air at ambient temperature so that their water contents are in the range of about 5 to 30% moisture, preferably about 10 to 25%, such as 17 to 22%. However, the moisture content of the molecular sieve zeolite being employed may be much lower, as was previously described, in which case the zeolite can be hydrated during crutching and other processing.

Preferably the zeolite should be in a finely divided state with the ultimate particle diameters being up to 20 microns, e.g., 0.005 or 0.01 to 20 microns, preferably being from 0.01 to 15 microns and especially preferably of 0.01 to 8 microns mean particle size, e.g., 3 to 7 or 12 microns, if crystalline, and 0.01 to 0.1 micron, e.g., 0.01 to 0.05 micron, if amorphous. Although the ultimate particle sizes are much lower, usually the zeolite particles will be of sizes within the range of 100 to 400 mesh, preferably 140 to 325 mesh. Zeolites of smaller sizes will often become objectionably dusty and those of larger sizes may not sufficiently and satisfactorily cover the carbonate-bicarbonate-silicate base particles.

The various powdered components employed, including the zeolite(s), bicarbonate, carbonate and sesquicarbonate, are normally quite finely divided, usually being of particle sizes which will pass through a No. 60 screen, U.S. Sieve series and remain on a No. 325 screen, preferably passing through a No. 160 screen and remaining on a No. 230 screen (although some of the zeolite may be finer). As was indicated previously, utilization of finely divided sodium sesquicarbonate is of a special importance and the sizes of all solid particulate materials charged should be small enough so that they do not obstruct spray tower nozzles.

Although it is highly preferred to make the crutcher slurry and the base beads product of this invention (from which a heavy duty built nonionic synthetic organic detergent composition can be produced) of essentially inorganic salts (including zeolite), in such manner that they will be of bead properties that promote absorption through the bead surfaces of nonionic detergent sprayed thereon in liquid form, and although often various adjuvants, such as perfumes, colorants, enzymes, bleaches and flow promoting agents, may be sprayed onto the beads with the nonionic detergent or may be post-added, for stable and normally solid adjuvants mixing in with the inorganic salt slurry in the crutcher is often feasible. Thus, it is contemplated that from 0 to as much as 20% of the crutcher slurry may be of suitable adjuvants or diluents (diluents include inorganic salts, such as sodium sulfate and sodium chloride). However, if such adjuvants are present, normally the proportion thereof will be from 0.1 to 10% and often their content will be limited to 5%, and sometimes to 1 or 2% (except that when sodium sulfate is such an adjuvant it may be present in greater quantity). Normally the organic material content of the crutcher slurry will be limited to about 5% maximum, preferably 3% maximum and most preferably 1 or 1.5% maximum, so as to avoid any problems of tackiness of the base beads after spray drying and also to avoid any adverse effects on absorption of the synthetic nonionic organic detergent by the beads. Because sodium sesquicarbonate is inorganic and helps to prevent gelation of the slurry without requiring changing of the desired carbonate-bicarbonate-silicate-zeolite formula of the beads to be made by spray drying the crutcher slurry, it allows the use of no citric material or less citric material than would normally otherwise be desirable, and also allows avoidance of the use of magnesium sulfate or permits diminution of the quantity thereof employed. Thereby, it promotes the production of more desirable, lower organic content beads and final products without using as much anti-gelling agent (other than the sesquicarbonate) and in some cases, without using any other such agent.

The present methods, utilizing sodium sesquicarbonate as an anti-gelling agent (or stabilizing agent for acceptably mobile crutcher slurries) have been surprisingly successful in preventing gelation, thickening, setting and freezing up of crutcher slurries of the present types before they can be emptied from the crutcher and spray dried, using normal crutching, pumping and spray drying equipment and following normal procedures. Such effects allow the manufacture of higher solids content slurries than would otherwise be workable, and allow the use of more carbonate in the finished product formula (obtainable from sodium carbonate and from sodium sesquicarbonate). In the past it has been found that when the ratio of sodium carbonate to sodium bicarbonate in such carbonate-bicarbonate-silicate-zeolite-water slurries exceeded a certain limit, usually in the range of 20 to 25%, e.g., 21% (or stated differently, when the proportion of sodium carbonate to sodium bicarbonate was greater than about 1:4.7), the slurry tended to set or thicken objectionably during crutching and processing. Such action sometimes placed limits on the slurry composition or requiring thinning of the mix or changing its temperature, so as to improve workability. Although a proportion of any bicarbonate is converted to carbonate in the heated spray tower, when it is desired for the spray dried base beads to be of a particular carbonate:bicarbonate ratio, sometimes such ratio would be unattainable because of the need to modify the crutcher conditions to obtain a workable crutcher mix. For example, if one were to try to produce an inorganic bead product of 1 part of carbonate to 2 parts of bicarbonate, even if 20% of the bicarbonate present decomposed to carbonate in the spray tower the ratio of carbonate to bicarbonate in the crutcher would be about 1:3.6, which is greater than 1:4.7. Thus, the present invention results in greater flexibility of crutcher composition specifications and crutcher operations and allows better choice and control of crutcher solids contents and base bead compositions, particularly with respect to the carbonate:bicarbonate ratio thereof.

The order of additions of the various components of the crutcher slurry is not considered to be critical, except that it is considered highly desirable for the sesquicarbonate to be added last after the zeolite, bicarbonate, carbonate (if any) and silicate, and preferably the silicate solution is added after the water, bicarbonate and carbonate. Usually the sesquicarbonate is added within ten minutes of the completion of addition of the silicate, preferably within five minutes, more preferably within one minute and most preferably immediately afterward. Previously, the silicate, being a "problem" component, had been admixed in over a comparatively long period of time, e.g., 5 to 15 minutes, but it has been found that such time may be diminished appreciably, for example, to from 1 to 4 minutes, e.g., 3.5 minutes, if sesquicarbonate is admixed in soon after, e.g., within two minutes of the completion of the silicate addition. Minor variations in orders of additions of the other constituents of the crutcher slurry may be made under certain circumstances, as when objectionable foaming accompanies the following of a specific, otherwise desirable order. However, such problems have not been found to be serious, in practice. In some instances it is possible to premix magnesium sulfate, when it is employed, with citric material and the mixture thereof may be added to the crutcher, usually before all other components except water. In other cases the citric material is added first, followed by magnesium sulfate, if employed, or vice versa. When citric material is being used it is preferred to add it to the water, followed by magnesium sulfate (when employed), zeolite, sodium bicarbonate, sodium carbonate (when employed), sodium silicate solution and sodium sesquicarbonate. Any of the usual detergent composition adjuvants are preferably added after the sodium sesquicarbonate but in some cases they may be added with or intermediate other components. Orders of addition of slurry materials may be changed providing that irreversible gelation does not occur, and sometimes, to speed processing, such changes may be desirable. For example, one may add some of the water to the crutcher initially, followed by portions of the inorganic salts, such as zeolite, bicarbonate and carbonate or any of them, followed by more water and more salt(s), and such may be done either before or after citric material and/or magnesium sulfate addition, if such citric material and/or magnesium sulfate is/are being employed. The water utilized may be city water of ordinary hardness, e.g., 50 to 150 p.p.m., as $CaCO_3$, or may be deionized or distilled water. The latter purified waters are preferred, if available, because some metallic impurities in the water can sometimes have a triggering action on gel formation, but in normal operations tap water and city water are acceptable.

The temperature of the aqueous medium in the crutcher will usually be elevated, often being in the 35° to 70° C. range, preferably being from 40° to 60° C. or 50° to 60° C. Heating the crutcher medium promotes solution of the water soluble salts of the slurry and thereby increases slurry mobility. However, temperatures higher than 70° C. will usually be avoided because of the possibility of decomposition or one or more crutcher mix components, e.g., sodium bicarbonate, and sometimes excess heating can cause setting of a gel. Heating of the crutcher mix, which may be effected by utilizing hot aqueous medium charged and by heating the crutcher and/or crutcher contents with a heating jacket or heating coils, also helps to increase drying tower throughput because less energy has to be transferred to the spray droplets of crutcher mix from the drying gas in the spray tower. Using higher solids content crutcher mixes, which is facilitated by the present method, also increases spray tower production rates.

Crutcher mixing times to obtain good slurries can vary widely, from as little as ten minutes for small crutchers and for slurries of higher moisture contents, to as much as four hours, in some cases. Usually the mixing times employed to bring all the crutcher mix components together in one satisfactorily "homogeneous" medium may be as little as five minutes but in some cases can be up to an hour, although 30 minutes is a preferable upper limit. Counting any such initial admixing times, normal crutching periods will be from 20 minutes to two hours, e.g., 30 minutes to one hour, but the present crutcher mixes will be such as to be mobile, not gelled or set, for at least one hour, preferably for two hours and more preferably for four hours or more after completion of the making of the mix, e.g., 10 to 30 hours, to allow for any processing delays.

The crutcher slurry, with the various salts, dissolved or in particulate form, uniformly distributed therein, is subsequently transferred from the crutcher or similar mixing means to a spray drying tower, which is usually located near the crutcher. The slurry is normally dropped from the bottom of the crutcher to a positive displacement pump, which forces it at high pressure, e.g., 7 to 50 kg./sq. cm., through spray nozzles at the top of a conventional spray tower (countercurrent or concurrent), wherein the droplets of the slurry fall through a heated drying gas, which is usually composed of the combustion products of fuel oil or natural gas, in which drying gas the droplets are dried to desired absorptive bead form, of a moisture content of from about 2 to 30%, preferably 4 to 20%, e.g., 5 to 15%, by a 105° C. oven weight loss method. During the drying operation at least part of the sesquicarbonate is converted to carbon dioxide, carbonate and water and at least part of the bicarbonate is converted to carbonate and water, with a release of carbon dioxide. These changes appear to improve the physical characteristics of the beads made so that they become more absorptive of liquids, such as nonionic detergents in liquid state, which may be post-sprayed onto them subsequently. Instead of pumping directly from the crutcher to the spray tower, sometimes, with the present treated crutcher mixes, it is possible to pump into a holdup tank and subsequently to pump to the spray tower. This may be done when the spray dryer throughput rate is lowered due to tower fires, cleanouts, packaging equipment failures, changeovers or other delays. Also, in some instances it may be desirable to have a pair of crutchers operating, each of which feeds an intermediate tank, from which the crutcher mix is pumped to the spray driers, thereby making the overall operation more continuous and less dependent on perfectly timing the makings and droppings of the crutcher mixes.

After drying, the product is screened to desired size, e.g., 10 to 100 mesh, U.S. Standard Sieve Series, and is ready for application of nonionic detergent spray thereto, with the beads being either in warm or cooled (to room temperature) condition. The nonionic detergent employed will usually be at an elevated temperature to assure that it will be liquid; yet, upon cooling to room temperature, desirably it will be a solid, often resembling a waxy solid. The nonionic detergent, applied to the tumbling beads in known manner, as a spray or as droplets, is preferably a condensation product of ethylene oxide and higher fatty alcohol, with the higher fatty alcohol being of 10 to 20 carbon atoms, preferably of 12 to 16 carbon atoms, and more preferably averaging 12 to 13 carbon atoms, and with the nonionic detergent containing from 3 to 20 ethylene oxide groups per mole, preferably from 5 to 12, more preferably 6 to 8. The proportion of nonionic detergent in the final product will usually be from 10 to 25%, such as from 20 to 25%, but more or less can be used, depending on the final detergent product characteristics sought and the flowability of the product obtainable.

A preferred finished formulation made from base beads produced in accordance with this invention contains from 15 to 25%, preferably 20 to 25% of the nonionic detergent, e.g., Neodol® 23-6.5, made by Shell Chemical Company, 30 to 40% of zeolite, 10 to 25% of sodium bicarbonate, 10 to 25% of sodium carbonate, 5 to 15% of sodium silicate of $Na_2O:SiO_2$ ratio of about 1:2.4, 1 to 3% of fluorescent brightener, 0.5 to 2% of proteolytic enzyme, sufficient bluing to color the product and whiten the wash, as desired, e.g., 0 to 0.5%, 0.5 or 1 to 15% of moisture, e.g., 10%, and 0.3 to 0.7% of citric material, as sodium citrate (when present). When magnesium sulfate is also present in the final product the proportion thereof will usually be from 1 to 2%. Of course, various non-essential adjuvants may be omitted, and if desired, others too, may be employed. Instead of the particular nonionic detergent mentioned other such detergents which are equivalent in function may be substituted. Optionally, sodium sulfate may be present as a diluent but the amount thereof will normally be restricted to 20%, preferably to 10%, and more preferably will be less than 5%, if any is present.

The base beads made, devoid of nonionic detergent and adjuvants, will preferably comprise 25 to 50% of zeolite, 13 to 33% of sodium bicarbonate, 13 to 33% of sodium carbonate, 6 to 20% of sodium silicate, 1 to 20% of moisture, 0.4 to 0.8% of citric material, as sodium citrate (when present), and 1.3 to 2.7% of magnesium sulfate (when present). In such spray dried beads and in the final detergent product the proportion of sodium bicarbonate will normally be within the range of 0.7 to 2.5 times that of sodium carbonate, e.g., 1 to 1.5, by weight.

The highly beneficial result of incorporating sodium sesquicarbonate in the present crutcher slurries in accordance with this invention is four-fold: (1) gelation and setting of the crutcher mix in the vessel before complete discharge thereof is prevented; (2) higher solids content crutcher slurries may be made; (3) higher carbonate content crutcher slurries may be made; and (4) such improvements may be obtained without the need to utilize anti-gelling adjuvants which would otherwise not be intentionally employed in the final base beads and detergent products. Also, when citric material, such as citric acid, and magnesium sulfate, such as calcined kieserite, are employed for their anti-gelling properties, lesser amounts thereof may be used and, in conjunction with the use of the sodium sesquicarbonate, improved anti-gelling and stabilizing effects are obtainable. Tests of the properties of the final base beads and detergent products indicate that no adverse effects result because of the utilization of the present invention and the incorporation in the products of the sodium sesquicarbonate. When citric acid or other citric material is employed it may also have desirable effects on the stabilities of perfumes and colors and may help to prevent the development of malodors from deteriorations of other organic materials that may be present, such as proteolytic enzymes and proteinaceous substances.

While it is clear that when crutcher slurries are made containing more than equimolar proportions of sodium bicarbonate with respect to sodium carbonate the addition of sodium sesquicarbonate at the end of the mixing method will reduce the ratio of carbonate to bicarbonate in the mix at earlier stages, thereby helping to prevent gelation (which appears to be worse when greater proportions of carbonate are present), this alone is not the explanation for the desirable effects obtained from the present invention. In related comparative experiments, when instead of the adding of the sodium sesquicarbonate at the end of the mixing process there are added stoichiometrically equivalent weights of soda ash and sodium bicarbonate, the anti-gelling and stabilizing effects on the sesquicarbonate addition are not obtained. Thus, such control mixes tend to gel earlier than those made in accordance with the present invention.

For a particular desired base bead composition, by varying the process of the present invention one may choose the highest solids content crutcher slurry feasible, normally employing a safety factor to avoid any accidental gelation in the crutcher, and may select the most desirable proportions of sodium carbonate and sodium bicarbonate to be "replaced" by sodium sesquicarbonate, considering economic and physical factors. In such methods which are within this invention stabilized workable crutcher slurries are obtainable and one may be assured that normal spray drying operations can be conducted without interruption and without the need for cleaning out of equipment being caused by a slurry being processed having thickened, gelled or set to an objectionable extent.

The following examples illustrate but do not limit the invention. Unless otherwise indicated all temperatures are in °C. and all parts are by weight in the examples and throughout the specification.

EXAMPLES 1-4

| Components | Example Parts by Weight 1 | 2 | 3 | 4 |
|---|---|---|---|---|
| Water (deionized) | 594 | 578 | 590 | 543 |
| Citric Acid | 4 | 4 | 4 | 4 |
| Magnesium Sulfate (calcined kieserite) | — | 16 | 16 | — |
| Zeolite 4A (20% water of hydration) | 366 | 366 | 366 | 366 |
| Sodium Bicarbonate | 190 | 190 | 220 | 151 |
| Soda Ash | 51 | 51 | 88 | — |
| Sodium Silicate (47.5% solids aqueous solution) | 236 | 236 | 236 | 236 |
| Sodium Sesquicarbonate | 160 | 160 | 80 | 268 |

Crutcher mixes of the above formulas are made by addition of the listed components in the order given to a heated crutcher, in which the temperature is maintained in the range of 40° to 60° C., being about 47° C. when the batch is dropped from the crutcher. The zeolite, sodium bicarbonate, soda ash and sodium sesquicarbonate are all in powder form, with particle sizes in the range of No's. 100 to 325, U.S. Sieve Series, with over 95% by weight of the sodium sesquicarbonate being in particles in the No. 160 to 230 range. After addition of the deionized water to the crutcher, subsequent additions of citric acid, magnesium sulfate (when employed) zeolite, sodium bicarbonate, soda ash (when employed) silicate and sodium sesquicarbonate are all effected quickly, with the additions of the citric acid and magnesium sulfate each being carried out within about 30 seconds and with the additions of zeolite, bicarbonate, carbonate, silicate and sesquicarbonate being within about three, two, one to two, three to four and two minutes, respectively, and with intervals between additions being between none and two minutes, usually being between ten seconds and one minute.

The crutcher mix of Example 1 was thick before silicate was added but thinned quickly with additions of the silicate and the stabilizing sesquicarbonate. The initial viscosity of this crutcher mix, utilizing a Brookfield LVF Viscometer for measuring it, is 550 centipoises and the viscosity of a sample of the crutcher mix, taken and retained for 24 hours and kept at 38° C., is then measured as 427 centipoises. The Example 2 crutcher mix, with magnesium sulfate, was more fluid than that of Example 1. The mix of Example 3 remains satisfactorily fluid during its manufacture and subsequent storage. The crutcher slurry of Example 4 was very thick but was processable at a higher solids content than that of Example 1 and its viscosity diminished upon standing. Thus, when initially made its viscosity was 1,600 centipoises but after 24 hours it was 400 centipoises. In all of the examples the crutcher mix could be mixed for an additional hour or two and was storable for at least two hours, and in the cases mentioned was stable for 24 hours, without thickening unduly and without gelling. In fact, as indicated, upon standing the products of both Examples 1 and 4 became thinner, whereas normal inorganic crutcher slurries based on zeolite, bicarbonate, carbonate and silicate, wherein the carbonate content is significant, tend to thicken objectionably after much shorter periods. Although the presence of citric acid and magnesium sulfate help to thin the crutcher mixes, when they are present the use of the sesquicarbonate alone also has an appreciable thinning and stabilizing effect and can prevent gelation of the slurries so as to permit more convenient spray drying operations than are obtainable when it is not employed.

Following ten minutes of mixing after completion of the makings of the crutcher slurries, they are dried in a countercurrent spray dryer into which they are sprayed through nozzles under a pressure of about 40 kg./sq. cm. The drying gas in the spray dryer is at a temperature in the range of 250° to 350° C. Such drying processes yield free flowing base beads of particle sizes in the range of No. 8–160, U.S. Sieve Series, and of a moisture content in the range of 8 to 13%, with some variations therein depending on variations in the crutcher formulas and on spray dryer conditions. The products are of a bulk density of about 0.6 g./ml. and their flow rates are in the range of about 80–90% of that of an equal volume of dry sand of comparable particle size. See U.S. Pat. No. 4,629,722 issued May 26, 1981 corresponding to U.S. patent application Ser. No. 964,037, filed Dec. 21, 1978, for a description of the method for determining flowability. The desirable properties of the beads made are considered to be attributable to a significant extent to the conversion of a part of the bicarbonate content to carbonate (usually a 10 to 50% reaction) and the at least partial changing of the sesquicarbonate to carbon dioxide, carbonate and water in the spray dryer.

The various base beads made, of a temperature of about 30° C., are sprayed, while being tumbled, with a nonionic detergent, Neodol 23-6.5, manufactured by Shell Chemical Company, which is in liquid state and at a temperature of about 45° C. The built detergent compositions made, unperfumed and without enzymes, fluorescent brighteners and bluing agents (although the fluorescent brighteners and bluing agents are sometimes included in the crutcher mix), which are often present in various commercial products, contain about 22% of the nonionic detergent, and when cooled to room temperature, are satisfactorily free flowing, with flowabilities over 70%. The products are excellent heavy duty laundry detergents, although commercial products will have the mentioned adjuvants present too, for aesthetic and performance reasons. The base beads are each of characteristic pore structures capable of absorbing nonionic detergent into the interiors thereof when it is in liquid state, and the final detergent products contain substantial proportions (more than half) of the nonionic detergent in the interiors of the beads thereof.

When variations of the described invented methods are run, utilizing normal adjuvants for commercial built detergent products, such as 1.5% of fluorescent brightener and 0.15% of blue pigment in the crutcher slurry and 1.4% of proteolytic enzyme and 0.1% of perfume in the final product, applied by admixing and spraying, respectively, essentially the same results are obtained. Similar results are also obtainable when the solids contents of the crutcher slurries are further increased, up to a maximum of about 70% (usually to more than 65%), with care being taken to utilize anti-gelling materials, desirable proportions of slurry components, favorable temperature conditions and good mixing, and to follow the described procedure closely. Comparable results are also obtainable when magnesium sulfate is employed in Examples 3 and 4, when the temperature is raised to over 50° C., e.g., 55° C., and even when the silicate content is increased substantially, e.g., by 25% thereof and the bicarbonate content is diminished accordingly.

When the proportions of the various components of the formulas processed by the method of this invention are varied ±10%, ±20%, ±30% but are maintained within the ranges of proportions previously specified, and when the invented method steps are followed, correspondingly successful non-gelling and stable crutcher slurries are obtainable.

COMPARATIVE EXAMPLES 5 AND 6

| Components | Example Parts by Weight 5 | 6 |
|---|---|---|
| Water (deionized) | 622 | 618 |
| Citric Acid | — | 4 |
| Zeolite 4A (20% water of hydration) | 366 | 366 |
| Sodium Bicarbonate | 250 | 250 |
| Soda Ash | 126 | 126 |
| Sodium Silicate (47.5% solids aqueous solution) | 236 | 236 |

The materials employed are the same as those of the previous examples, as are the procedural steps, with the exception that there is no addition of sodium sesquicarbonate and the period of the addition of silicate is longer, about eight minutes, to prevent premature gelation. Despite constant vigorous stirring (a turbine mixer operating at about 2,000 r.p.m.) the slurries solidify or become objectionably thick although that of Example 6 is superior to that of Example 5. The crutcher slurry of Example 5 gelled during silicate addition whereas that of Example 6 was initially workable.

The invention has been described with respect to various illustrations and embodiments thereof but is not to be limited to these because it is evident that one of skill in the art, with the present description before him, will be able to utilize substitutes and equivalents without departing from the invention.

What is claimed is:

1. A method of retarding or preventing the gelation of a crutcher slurry containing from about 40 to 70% of solids and 60 to 30% of water, of which solids content, on a 100% solids basis, about 20 to 60% is zeolite, about 11 to 45% is sodium bicarbonate, about 4 to 20% is sodium carbonate and about 5 to 20% is sodium silicate of $Na_2O:SiO_2$ ratio within the range of 1:1.4 to 1:3, with the ratio of sodium bicarbonate:sodium carbonate being within the range of about 1.2:1 to 8:1, the ratio of sodium carbonate:sodium silicate being within the range of about 1:3 to 3:1, the ratio of sodium bicarbonate:-sodium silicate being within the range of about 1.5:1 to 5:1 and the ratio of zeolite to the sum of sodium bicarbonate, sodium carbonate and sodium silicate being within the range of about 1:4 to 4:1, which comprises preparing a crutcher slurry of the described composition by admixing with other components of such slurry an amount of sodium sesquicarbonate which will supply from about 20 to 100% of the sodium carbonate.

2. A method according to claim 1 wherein the crutcher slurry contains from 50 to 65% of solids and 50 to 35% of water, of which solids content 30 to 50% is zeolite, 25 to 40% is sodium bicarbonate, 8 to 17% is sodium carbonate and 8 to 18% is sodium silicate of $Na_2O:SiO_2$ ratio within the range of 1:1.6 to 1:2.6, the ratio of sodium bicarbonate:sodium carbonate is within the range of 1.5:1 to 3:1, the ratio of sodium carbonate:-sodium silicate is within the range of 1:2 to 2:1, the ratio of sodium bicarbonate:sodium silicate is within the range of 1.5:1 to 3:1 and the ratio of zeolite to the sum of sodium bicarbonate, sodium carbonate and sodium silicate is within the range of 1:3 to 2:1.

3. A method according to claim 1 wherein the crutcher slurry contains from 0.05 to 1% of a gelation inhibiting citric material selected from the group consisting of citric acid, water soluble citrate and mixtures thereof, which is incorporated in the slurry before addition of the sodium sesquicarbonate thereto.

4. A method according to claim 2 wherein the crutcher slurry contains from 0.1 to 0.5% of a gelation inhibiting citric material selected from the group consisting of citric acid, water soluble citrate and mixtures thereof, which is incorporated in the slurry before addition thereto of the sodium silicate and sodium sesquicarbonate.

5. A method according to claim 3 wherein the crutcher slurry contains from 0.1 to 2% of magnesium sulfate.

6. A method according to claim 4 wherein the zeolite is a Type A zeolite.

7. A method according to claim 6 wherein the order of addition to the crutcher of the components to form the crutcher slurry is water, citric material, zeolite, sodium bicarbonate, sodium carbonate, sodium silicate, as an aqueous solution, and sodium sesquicarbonate, and wherein the proportion of sodium carbonate supplied by the sodium sesquicarbonate is from 40 to 100% thereof.

8. A method according to claim 7 wherein the crutcher slurry is at a temperature in the range of 35° to 70° C. and is at atmospheric pressure.

9. A method according to claim 8 wherein the crutcher slurry contains from 53 to 65% of solids and 47 to 35% of water, of which solids content 35 to 45% is zeolite, 25 to 35% is sodium bicarbonate, 10 to 15% is sodium carbonate and 10 to 15% is sodium silicate of $Na_2O:SiO_2$ ratio within the range of 1:2 to 1:2.4, the ratio of sodium bicarbonate:sodium carbonate is within the range of 1.7:1 to 2.2:1, the ratio of sodium carbonate:sodium silicate is within the range of 0.7:1 to 1.3:1, the ratio of sodium bicarbonate:sodium silicate is within the range of 1.7:1 to 2.4:1, the ratio of zeolite to the sum of sodium bicarbonate, sodium carbonate and sodium silicate is within the range of 1:2 to 1:1, the citric material is added as citric acid, the percentage of citric acid is 0.4 to 0.8%, on a solids basis and the percentage of sodium sesquicarbonate added is from 5 to 32%, on such solids content basis.

10. A method according to claim 1 wherein the mixing is at an elevated temperature, in the range of 35° to 70° C. and such mixing or holding is continued for at least one hour after completion of the making of crutcher slurry.

11. A method according to claim 9 wherein the crutcher slurry temperature is from 40° to 60° C., mixing or holding of the slurry is effected for at least two hours after completion of the making of the slurry, and at least a part of the slurry, after such two-hour period, is pumped out of the crutcher to a spray drying tower and is spray dried therein to dry particulate form.

12. A method according to claim 4 wherein the gelation preventing citric material is citric acid.

13. A method according to claim 12 wherein from 0.1 to 10% of the crutcher slurry is of adjuvant(s) and/or diluent(s).

14. A method according to claim 4 wherein the crutcher slurry contains from 0.2 to 1.5% of magnesium sulfate.

15. A method according to claim 12 wherein the percentage of citric acid is from 0.2 to 0.4, the crutcher slurry contains from 0.8 to 1.2% of magnesium sulfate and the citric acid and magnesium sulfate are incorporated in the slurry before addition thereto of at least some of the sodium silicate.

16. A method of making a particulate base material in bead form, suitable for absorbing nonionic detergent to make a built heavy duty synthetic organic detergent composition, which comprises making a miscible and pumpable slurry in a crutcher by the method of claim 1, pumping the slurry out of the crutcher in ungelled and readily pumpable state and spray drying the slurry to particulate bead form, during which spray drying a portion of the sodium sesquicarbonate is converted to sodium carbonate and a portion of the sodium bicarbonate is converted to sodium carbonate.

17. A method according to claim 16 wherein the sodium sesquicarbonate added to the crutcher slurry is of particle sizes in the range of No's. 160 to 230, U.S. Sieve Series.

18. A method according to claim 1 wherein the sodium sesquicarbonate added to the crutcher slurry is of particle sizes in the range of No's. 60 to 325, U.S. Sieve Series.

* * * * *

UNITED STATES PATENT AND TRADEMARK OFFICE

CERTIFICATE OF CORRECTION

PATENT NO. : 4,311,607
DATED : January 19, 1982
INVENTOR(S) : James A. Kaeser

It is certified that error appears in the above—identified patent and that said Letters Patent is hereby corrected as shown below:

In the Abstract, line 9, change "preferbly" to --preferably--.

Column 6, line 61, change "4A" to --4Å--.

Column 7, line 22, change "is" to --in--.

Column 13, line 39, after "they are" insert --not--.

Signed and Sealed this

*Twenty-seventh* Day of *April 1982*

[SEAL]

*Attest:*

GERALD J. MOSSINGHOFF

*Attesting Officer*

*Commissioner of Patents and Trademarks*